US005173666A

United States Patent [19]

Babbitt et al.

[11] Patent Number: 5,173,666

[45] Date of Patent: Dec. 22, 1992

[54] MICROSTRIP-TO-INVERTED-MICROSTRIP TRANSITION

[75] Inventors: Richard W. Babbitt, Fair Haven; Thomas E. Koscica, Clark; Adam Rachlin, Eatontown, all of N.J.

[73] Assignee: The United States of America as represented by the Secretary of the Army, Washington, D.C.

[21] Appl. No.: 858,729

[22] Filed: Mar. 27, 1992

[51] Int. Cl.[5] ..... H01P 5/08

[52] U.S. Cl. ..... 333/33; 333/34; 333/35

[58] Field of Search ..... 333/33, 34, 35, 238, 333/246, 260

[56] References Cited

U.S. PATENT DOCUMENTS

| | | | |
|---|---|---|---|
| 2,800,634 | 7/1957 | Grieg et al. | 333/238 |
| 3,904,997 | 9/1975 | Stinehelfer, Sr. | 333/33 X |
| 5,057,798 | 10/1991 | Moye et al. | 333/33 |

FOREIGN PATENT DOCUMENTS

| | | | |
|---|---|---|---|
| 74946 | 6/1981 | Japan | 333/33 |

*Primary Examiner*—Paul Gensler

*Attorney, Agent, or Firm*—Michael Zelenka; William H. Anderson

[57] ABSTRACT

A microstrip-to-inverted-microstrip transition for providing a low-loss connection of a microstrip to an inverted microstrip in planar microwave devices. One embodiment includes tapered dielectric and conductor sections that provide a gradual or tapered change in the effective dielectric constant and a substantially constant characteristic impedance across the transition. A second embodiment employs a series of microstrip transformers that are one-quarter wavelength long. The transformers have dielectric members that have successively decreasing dielectric constants to provide a gradual dielectric match. The geometries of the microstrip transformers are chosen so that there will be an impedance match across the transition. A third embodiment employs the microwave interaction that takes place with the supporting dielectrics of the inverted microstrip to produce a dielectric match. The conductor spacing of the inverted microstrip is adjusted such that the effective dielectric constant of the inverted microstrip is close to or equal to that of the microstrip.

17 Claims, 3 Drawing Sheets

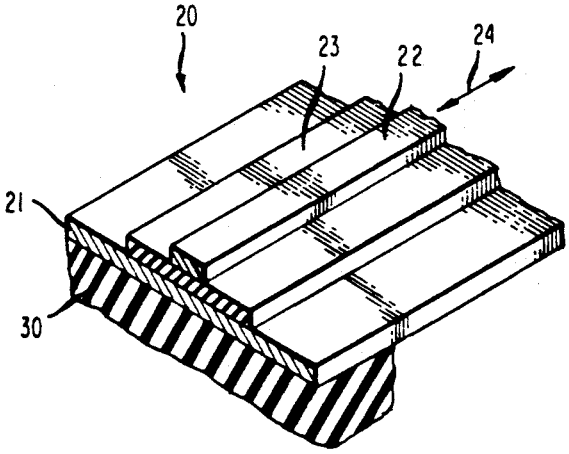
FIG. 1
PRIOR ART
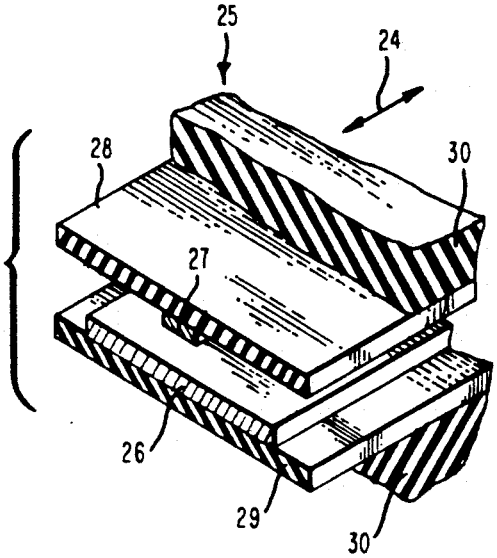
FIG. 2
PRIOR ART
FIG. 3A
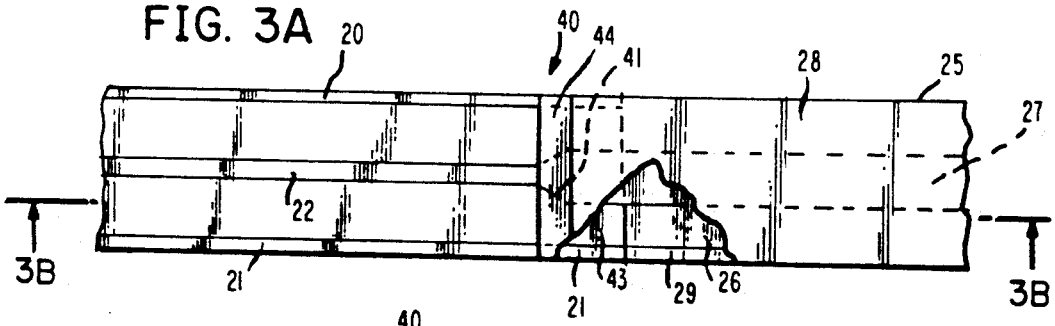
FIG. 3B
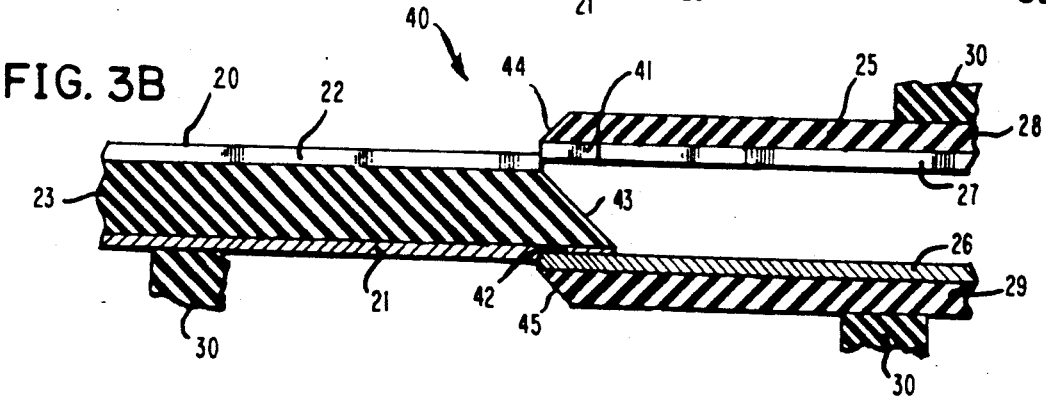

MICROSTRIP-TO-INVERTED-MICROSTRIP TRANSITION

GOVERNMENT INTEREST

The invention described herein may be manufactured, used, and licensed by or for the Government for governmental purposes without the payment to us of any royalty thereon.

BACKGROUND OF THE INVENTION

1. Field of the Invention

This invention relates to microwave transmission circuits. More particularly, the invention relates to a transition circuit for joining a microstrip with an inverted microstrip.

2. Description of the Prior Art

Those concerned with the development of planar microwave devices having large sections of microstrip have recognized that in some instances their performance could be enhanced significantly if inverted microstrip could be substituted for portions of the microstrip. It is known that at microwave frequencies higher than 26 GHz, for example, significant losses commonly occur in the dielectric substrates of conventional microstrip. In many situations these losses may be reduced substantially with the use of inverted microstrip because most of the electromagetic energy in inverted microstrip is transmitted in the low-loss air space between the strip conductor and the ground plane.

Also, in many planar circuit designs it is physically more convenient and cheaper to use inverted microstrip instead of microstrip. This is particularly the case in the fabrication of thin-film superconducting planar microwave devices. Conventional superconducting films are currently deposited on only one side of a dielectric substrate, making them difficult to use in a microstrip configuration where both sides of a dielectric substrate are coated with a conductive film.

Although it has been recognized that in many situations it is desirable to use both microstrip and inverted microstrip in a common circuit, no practical apparatus for making low-loss connections between microstrip and inverted microstrip has yet been devised. Ideally, such apparatus should provide a low-cost, low-loss transition between microstrip and inverted microstrip. The present invention fulfills this need.

SUMMARY OF THE INVENTION

It is an object of this invention to provide a simple, low-cost microstrip-to-inverted-microstrip transition which makes it possible to insert high-performance inverted microstrip devices, such as superconducting resonators and filters, into high frequency microwave circuitry.

Another object of this invention is to provide a planar transition circuit that allows the replacement of high-loss microstrip circuits, such as antennas, with lower loss inverted microstrip circuits.

The present invention contemplates a unique planar microwave transition circuit having a tapered structure whereby a gradual change in the effective dielectric constant is achieved to avoid reflections of microwave energy at the transition. Another aspect of the invention contemplates a planar microwave transition circuit with a series of transformers having different effective dielectric constants to provide for a smooth transition. A further aspect of the invention tailors the effective dielectric match of the transition by adjusting the conductor spacing as a function of the characteristics of the supporting dielectric of the inverted microstrip.

BRIEF DESCRIPTION OF THE DRAWINGS

These and other objects, features, and details of the invention will become apparent in light of the ensuing detailed disclosure, and particularly in light of the drawings wherein:

FIG. 1 is a pictorial view partly in section of a prior art microstrip.

FIG. 2 is a pictorial view partly in section of a prior art inverted microstrip.

FIG. 3A is a top view with parts broken away of a preferred embodiment of the invention.

FIG. 3B is a side elevation of the preferred embodiment of FIG. 3A shown in a cross section taken on the line 3B—3B of FIG. 3A and looking in the direction of the arrows.

BRIEF DESCRIPTION OF THE PREFERRED EMBODIMENTS

Figure 4A:
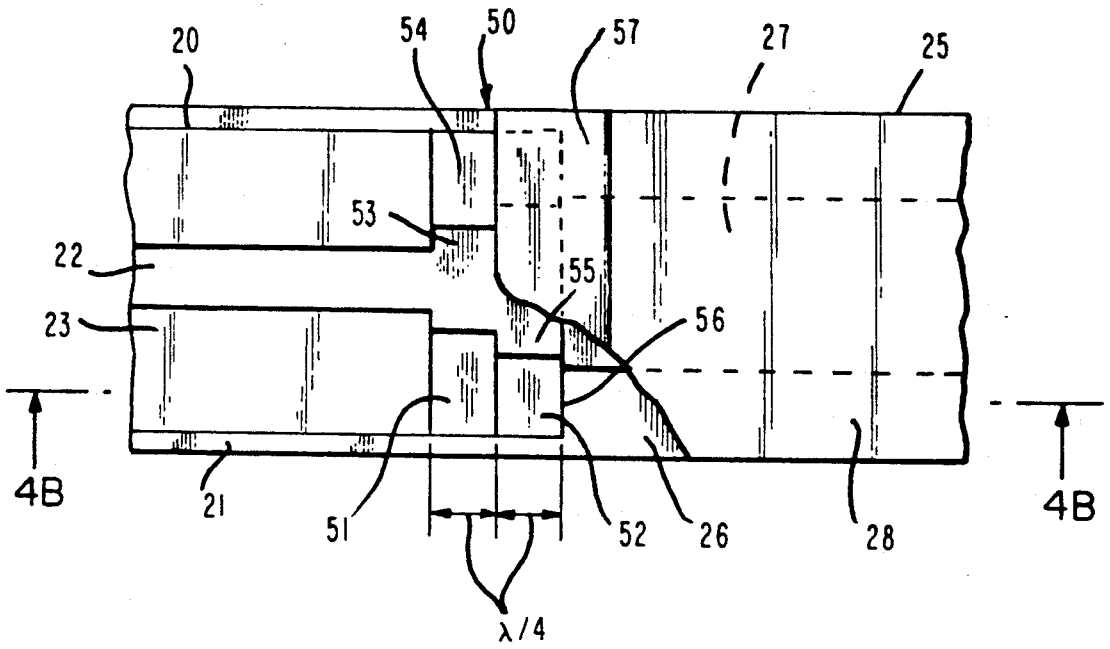
FIG. 4A is a top view with parts broken away, similar to the view in FIG. 3A, of a second embodiment of the invention.

Referring now to the drawings there is shown a prior art microstrip 20 having a relatively wide ground-plane conductor 21 that is spaced from a narrow strip conductor 22. A dielectric 23 supports conductors 21, 22 on either side thereof. Such microstrip is commonly used as transmission line at ultrahigh and microwave frequencies. The characteristic impedance of microstrip is a function of the width of strip 22, the spacing between conductors 21, 22, and the dielectric constant of dielectric 23. Microstrip 20 acts as a waveguide that permits electromagnetic energy to be transmitted in either direction as indicated by bidirectional arrow 24. When transmitted, the energy is substantially contained in the dielectric 23. In most applications, microstrip 20 is physically supported by either dielectric 23 with ground-plane conductor 21 or an independent structural support 30.

FIG. 2 shows a conventional inverted microstrip 25 having a relatively wide ground plane conductor 26 that is spaced from a narrow strip conductor 27. A first dielectric 28 supports conductor 27 while a second dielectric 29 supports conductor 26. Dielectrics 28 and 29 are usually supported by conventional supports 30 to maintain conductors 26, 27 in the spaced position shown.

Inverted microstrip 25 also acts as a waveguide and will transmit electromagnetic energy primarily in the air space between conductors 26, 27. A small amount of energy is also transmitted in dielectric 28. The characteristic impedance of inverted microstrip 25 is a function of the width of strip conductor 27, the spacing between conductors 26, 27, and the effective dielectric constant of inverted microstrip 25. The effective dielectric constant, being a function of the dielectric constants of the air and dielectric 28, will usually be very close to that of the air because, as mentioned above, substantially all of the transmitted energy is confined to the air space. In general, the effective dielectric constant of inverted microstrip 25 will be significantly lower than that of microstrip 20. Consequently, inverted microstrip 25 transmits energy with less loss than microstrip 20, particularly at the higher microwave frequencies.

FIGS. 3A & 3B illustrate conventional microstrip 20 and inverted microstrip 25 joined by a tapered transition 40. Strip conductor 22 abuts the end of a tapered conductor 41 that is joined to the end of strip conductor 27, which is shown to be wider than strip conductor 22. Ground-plane conductor 21 has an end 42 that overlaps the end portion of ground-plane conductor 26 which, at transition 40, extends into the air space between conductors 26, 27. Dielectric 23 terminates in a tapered wedge 43 that also extends into the air space between conductors 26, 27. At transition 40, the ends of dielectrics 28, 29 terminate in tapers 44, 45, respectively.

For tapered transition 40, the effective dielectric constant is a function of the dielectric constants of dielectrics 23, 28 and air and the transitional shapes introduced by wedge 43 and taper 44. At distances spaced from transition 40, the effective dielectric constant of inverted microstrip 25 is substantially equal to that of air, and the effective dielectric constant of microstrip 20 is substantially equal to the dielectric constant of dielectric 23, which in most instances is much greater than that of air. Because of the wedge 43 and taper 44, the effective dielectric constant gradually changes across transition 40. Also, the circuit impedance can be held substantially constant across transition 40 and along microstrip 20 and inverted microstrip 25. In this regard, the gradual increase in the width of the circuit provided by tapered conductor 41 accommodates the lower dielectric constant of the air. The longer that transition 40 is the greater the frequency bandwidth that transition 40 will operate over.

Figure 4B:
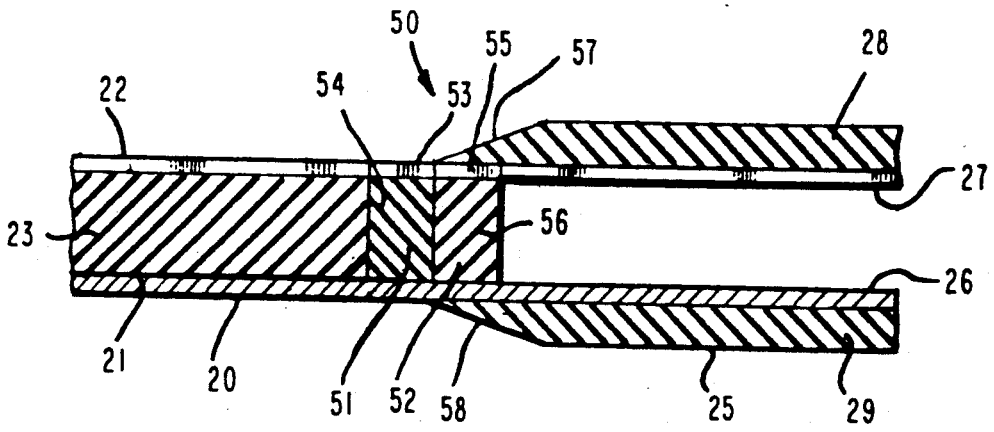
FIG. 4B is a side elevation in cross section taken on the line 4B—4B of FIG. 4A and looking in the direction of the arrows.

FIGS. 4A and 4B show a transition 50 which is an alternate embodiment of the invention. Transition 50 comprises two quarter-wave transformers 51, 52 that join microstrip 20 to inverted microstrip 25. Transformer 51 includes a conductive strip 53 that is wider than strip conductor 22 to which it is attached and is one-quarter wavelength long. Strip 53 is supported on a dielectric 54, also one-quarter wavelength long, that is mounted on ground-plane conductor 21 and abuts the end of dielectric 23.

Transformer 52 includes a conductive strip 55 that is one-quarter wavelength long and is connected at either end to strip 53 of transformer 51 and strip conductor 27 of inverted microstrip 25. The strip 55 is wider than strip 53 and is narrower than strip conductor 27. Strip 55 is supported on a dielectric 56 that is mounted on ground-plane conductor 21. The ends of dielectrics 28, 29 have tapers 57, 58, respectively, that extend over transformer 52.

In the embodiment of FIGS. 4A and 4B, dielectrics 23, 54, 56 have different dielectric constants E23, E54, E56, respectively, such that their values are related as follows: E23>E54>E56. This arrangement results in a gradual transition in the effective dielectric constant across transition 50. Also, the characteristic impedance across transition 50 is held substantially constant by the increasing widths of the circuit via strips 53, 55 to accommodate for the lower dielectric constants of dielectrics 54, 56. If a smaller operational bandwidth is acceptable, only one transformer, say transformer 52, may be necessary.

Figure 5A:
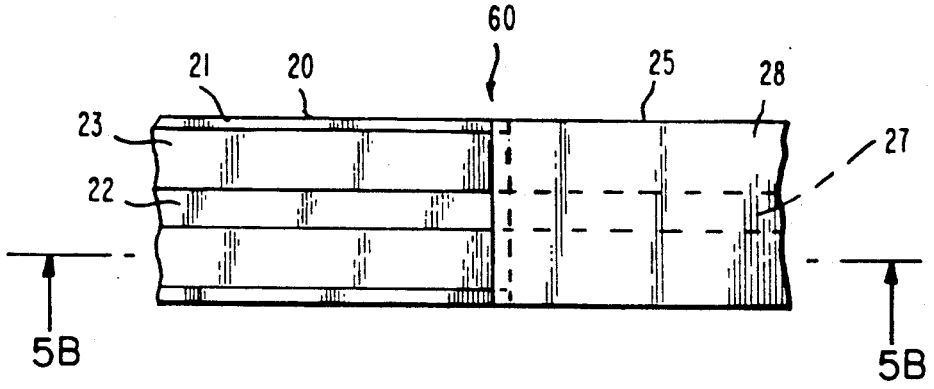
FIG. 5A is a top view, similar to the views in FIGS. 3A and 4A, of a third embodiment of the invention.
Figure 5B:
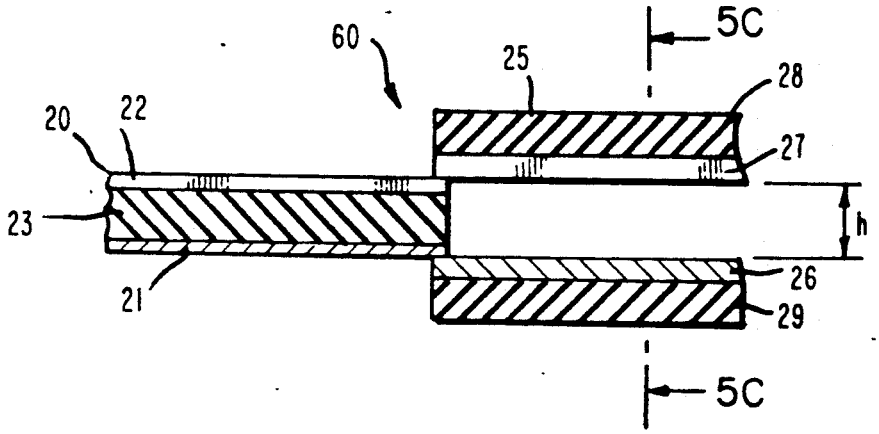
FIG. 5B is a side elevation in cross section taken on the line 5B—5B of FIG. 5A and looking in the direction of the arrows.
Figure 5C:
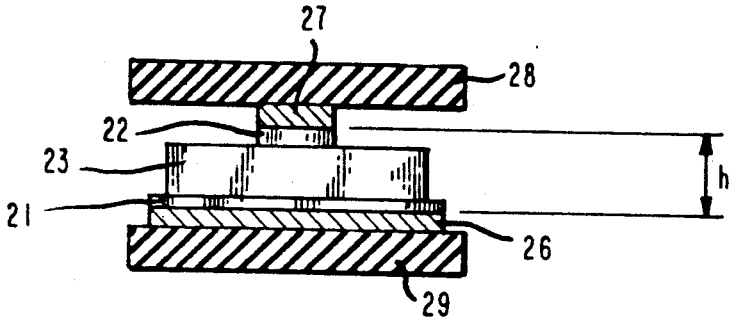
FIG. 5C is an end view in cross section taken on the line 5C—5C of FIG. 5B and looking in the direction of the arrows.

FIGS. 5A-5C illustrate transition 60 which is a further embodiment of the invention. Transition 60 uses the microwave interaction that takes place with supporting dielectric 28 of inverted microstrip 25 to achieve a smooth transition. As pointed out above, inverted microstrip 25 has an effective dielectric constant, designated here as (Ef), that is greater than that of air. As noted above, the effective dielectric constant (Ef) of inverted microstrip 25 is close to that of air because most of the energy is contained in the air space between strip conductor 27 and ground-plane conductor 26. However, (Ef) will also be a function of the dielectric constant of dielectric 28. Additionally, the effective dielectric constant (Ef) will also be a function of the spacing (h) between the strip conductor 27 and the ground-plane conductor 28.

With proper adjustment of these parameters, it is contemplated that a dielectric match may be achieved with transition 60. For example, if dielectric 28 has a dielectric constant of nine, the effective dielectric constant (Ef) of inverted microstrip 25 will vary from 2.1 to 2.6 as the spacing (h) is decreased from 2032 micrometers to 508 micrometers. In this example, if a substrate like "Duroid" with a dielectric constant of 2.2, which is well within the 2.1 to 2.6 range, is used for dielectric 23 of microstrip 20, a height (h) may be selected to realize a dielectric match via transition 60.

Transition 60 simply involves the placing of the end portion of microstrip 20 into the air space between strip conductor 27 and ground-plane conductor 26. The height or thickness of strip conductor 22 and ground-plane conductor 21 are chosen so that the overall height of microstrip 20 is at least equal to (h), making it possible to complete electrical connections between strips 22, 27 and ground-plane conductors 21, 26. As indicated above, height (h) and the dielectric constant of dielectric 28 are chosen such that the effective dielectric constant (Ef) of inverted microstrip 25 matches that of microstrip 20. Also, the impedances of microstrip 20 and inverted microstrip 25 may be readily matched by adjusting their appropriate physical dimensions, such as the spacings of strip conductors 22, 27 and ground-plane conductors 21, 26 and the widths of strip conductors 22, 27.

Various other modifications are contemplated and may obviously be resorted to by those skilled in the art without departing from the spirit and scope of the invention, as hereinafter defined by the appended claims, as only preferred embodiments thereof have been dislcosed.

What is claimed is:

1. a microstrip-to-inverted-microstrip transition comprising:

a microstrip having a first effective dielectric constant, the microstrip comprising a first dielectric sandwiched between a conductive ground plane and a conductive strip;

an inverted microstrip having a second effective dielectric constant which is less than the first dielectric constant, the inverted microstrip comprising at least two parallel conductors separated by an air space;

a transition means connecting said microstrip to said inverted microstrip, and having a third effective dielectric constant that is between said first and second effective dielectric constants, wherein said transition means includes at least one tapered dielectric.

2. The transition of claim 1 wherein the characteristic impedance, at the operating frequency, of said microstrip, said inverted microstrip and said transition means are substantially equal.

3. The transition of claim 2 wherein said transition means includes a dielectric wedge extending from one end of said microstrip into said air space.

4. The transition of claim 3 wherein said transition means includes a tapered conductor.

5. The transition of claim 1 wherein said transition means includes at least one transformer means having a dielectric member made of a material having a dielectric constant that is less than said first effective dielectric constant.

6. The transition of claim 5 wherein said transformer means has impedance matching means for matching the characteristic impedance of said transformer means to that of said microstrip.

7. The transition of claim 1 wherein said transition means includes at least first and second transformer means mounted serially between said microstrip and said inverted microstrip, and wherein each said transformer means includes a dielectric material having a dielectric constant that is less than said first effective dielectric constant and is greater than said second effective dielectric constant.

8. The transition of claim 7 wherein said first transformer means is connected to said microstrip and said second transformer means is connected between said first transformer means and said inverted microstrip and wherein the dielectric constant of said dielectric material in said first transformer means is greater than the dielectric constant of said dielectric material in said second transformer means.

9. The transition of claim 8 wherein each said transformer means includes impedance matching means for matching the characteristic impedance of said transformers to that of said microstrip.

10. The transition of claim 9 wherein said transformer means includes at least one tapered dielectric.

11. A microstrip-to-inverted-microstrip transition comprising:

a microstrip having a first dielectric support, a first conductive ground plane mounted on one side of said first support and a first conductive strip mounted on an opposite side of said first support; an inverted microstrip having second and third dielectric supports with opposed surfaces, a second conductive strip mounted on said opposed surface of said second dielectric support, a second conductive ground plane mounted on said opposed surface of said third dielectric support, and an air space between said second conductive strip and said second conductive ground plane; and a transition means having a tapered dielectric wedge extending from said first dielectric support into said air space and a tapered conductive strip connecting said first and second conductive strips.

12. The transition of claim 11 wherein said transition means further includes a conductive ground plane mounted on one surface of said wedge connected to said first and second conductive ground planes.

13. The transition of claim 12 wherein said transition means further includes tapered dielectric sections connected to the ends of said second and third dielectric support.

14. A microstrip-to-inverted-microstrip transition comprising:

a microstrip having a first dielectric support, a first conductive ground plane mounted on one side of said first support and a first conductive strip mounted on an opposite side of said first support; an inverted microstrip having second and third dielectric supports with opposed surfaces, a second conductive strip mounted on said opposed surface of said second dielectric support, a second conductive ground plane mounted on said opposed surface of said third dielectric support, and an air space between said second conductive strip and said second conductive ground plane; and a transition means having a series of microstrip transformers having different effective dielectric constants, each said transformer having a dielectric support, a conductive ground plane and a conductive strip, wherein said conductive strips of said transformers are connected in series between said first and second conductive strips.

15. The transition of claim 14 wherein said conductive ground plane of said transformers are connected in series between said first and second ground planes.

16. The transition of claim 15 wherein said dielectric supports of said transformers have different dielectric constants that are smaller than the dielectric constant of said first dielectric support.

17. The transition of claim 16 wherein said conductive strips of said transformers have different widths that are greater than the width of said first conductive strip and are less than the width of said second conductive strip.

* * * * *